US006549103B2

(12) United States Patent
Jilong

(10) Patent No.: US 6,549,103 B2
(45) Date of Patent: Apr. 15, 2003

(54) DEVICE AT FILTERS

(75) Inventor: Ju Jilong, Hörby (SE)

(73) Assignee: Teracom Components AB, Horby (SE)

( * ) Notice: Subject to any disclaimer, the term of this patent is extended or adjusted under 35 U.S.C. 154(b) by 0 days.

(21) Appl. No.: 09/821,391

(22) Filed: Mar. 29, 2001

(65) Prior Publication Data

US 2001/0028288 A1 Oct. 11, 2001

(30) Foreign Application Priority Data

Apr. 6, 2000 (SE) ..... 0001305

(51) Int. Cl.[7] ..... H01P 1/30; H01P 1/208
(52) U.S. Cl. ..... 333/229; 333/208
(58) Field of Search ..... 333/208, 229

(56) References Cited

U.S. PATENT DOCUMENTS 5,867,077 A * 2/1999 Lundquist ..... 333/208

* cited by examiner

*Primary Examiner*—Robert Pascal
*Assistant Examiner*—Stephen E. Jones
(74) *Attorney, Agent, or Firm*—Tarolli, Sundheim, Covell & Tummino L.L.P.

(57) ABSTRACT

The present invention relates to a device at filters for filtering unwanted signals from radio transmitters and/or for use during combination of radio transmitters. Said filter (1) has at least one cavity (2 and/or 3) for filtering radio signals. At least one compensating means (13 and/or 16) is provided to compensate for deviations in frequency depending on expansion or contraction of the cavity (2 and/or 3) due to expansion or contraction of the filter (1) when said filter is heated or cooled during operation. The filter (1) has at least one cavity (2 and/or 3) which is designed for simultaneous filtering of radio signals of at least three different modes (A, B and C and/or D, E and F) and the same frequency. The compensating means (13 and/or 16) is provided in said cavity (2 and/or 3) for compensating deviations in frequency by simultaneously affecting the radio signals of the at least three different modes (A, B and C and/or D, E and F).

23 Claims, 3 Drawing Sheets

DEVICE AT FILTERS

BACKGROUND OF THE INVENTION

The present invention relates to a device at filters for filtering unwanted signals from radio transmitters and/or for use during combination of radio transmitters, wherein said filter has at lease one cavity for filtering radio signals, and wherein at least one compensating means is provided to compensate for deviations in frequency depending on expansion or contraction of the cavity due to expansion or contraction of the filter when said filter is heated or cooled during operation, In order to limit the space the radio transmitter is occupying in the frequency spectrum, the radio signals must be filtered before they are transmitted into the ether. This is necessary since the modulation as well as imperfections in the power amplifier generate unwanted frequencies.

For carrying through the above function, prior art filters often have a cavity for filtering radio signals of or with one mode only.

This means that the filters often have many cavities, whereby the filter becomes very large and voluminous, causing high costs for material and production and requiring much space etc.

BRIEF SUMMARY OF THE INVENTION

The object of the present invention is to provide a filter which eliminates this drawback and this is arrived at by providing the filter with the characterizing features of the subsequent claims.

By providing the filter with said characterizing features, it has been possible to make the filter substantially smaller and cheaper than previously. Also, the filter renders it easier to carry through customer adapted trimmings or alignments for removing also specific unwanted signals.

BRIEF DESCRIPTION OF THE DRAWINGS

The invention will be further described below with reference to the accompanying drawings, in which.

DETAILED DESCRIPTION OF THE INVENTION

Figure 1:
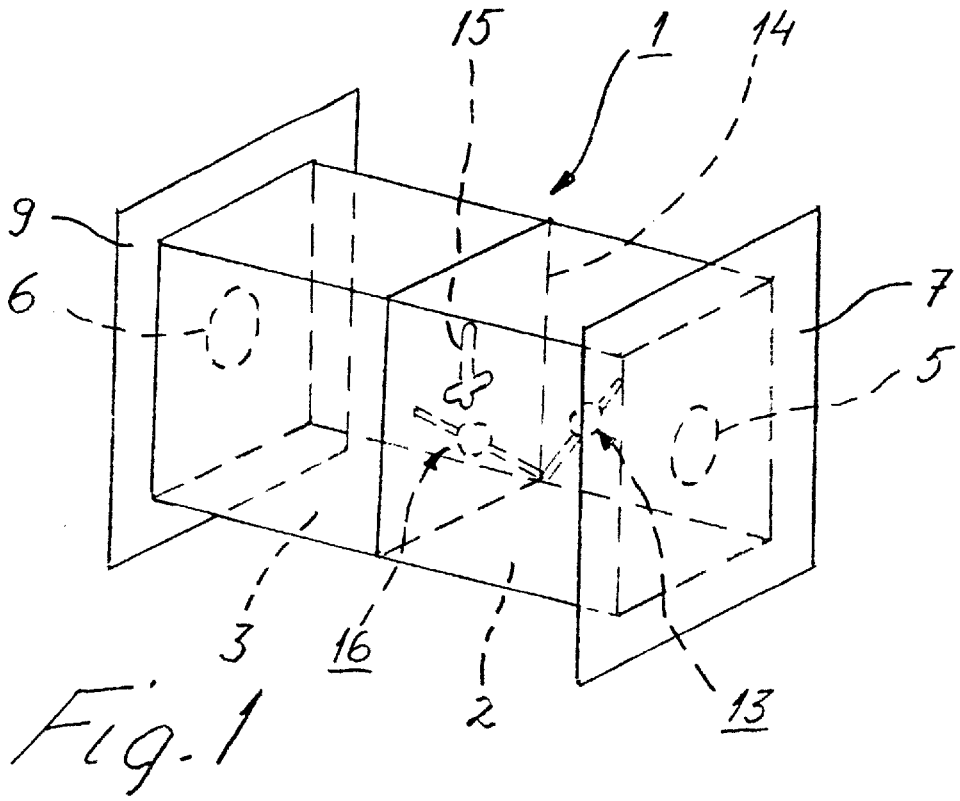
FIG. 1 is a perspective view of a filter having a device according to the invention.
Figure 2:
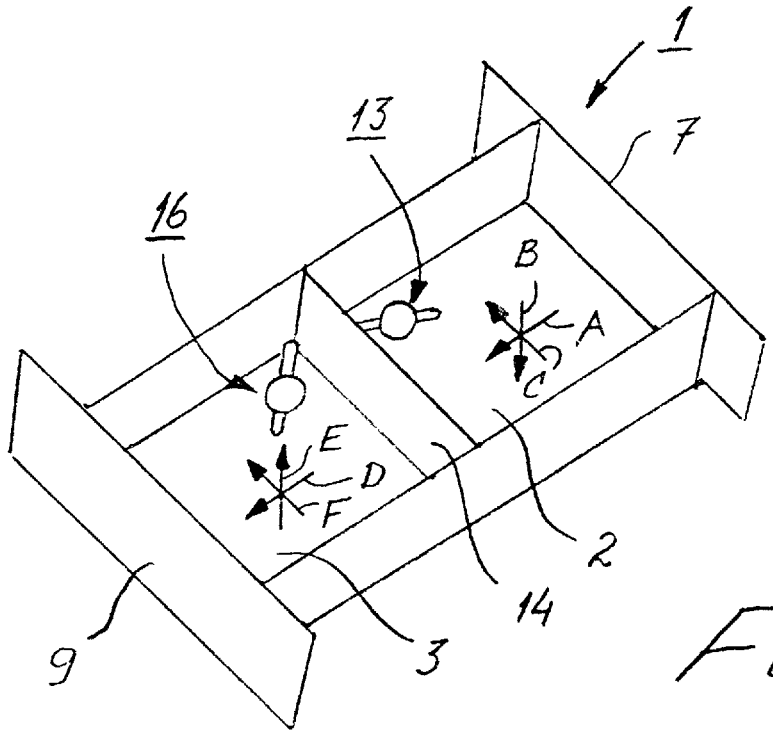
FIG. 2 is a perspective view of the filter of FIG. 1 and with upper parts exposed.
Figure 3:
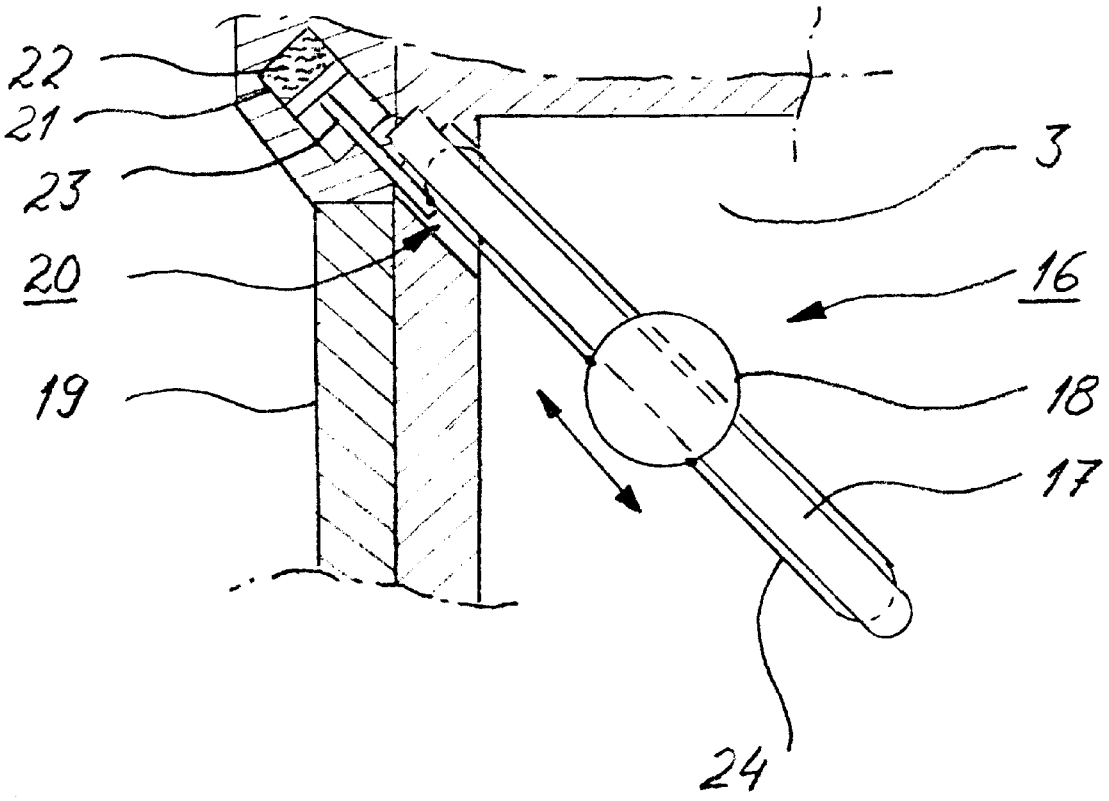
FIG. 3 illustrates a compensating means forming part of the filter of FIGS. 1 and 2.

The filter 1 illustrated in the drawings is adapted for filtering unwanted signals from radio transmitters and/or for use during combination of radio transmitters. The filter is preferably intended for radio signals within a range of frequencies of 300 MHz–3 GHz and preferably within a power range of 200 W–50 kW.

The filter 1 is made from aluminium and in the illustrated embodiment it defines two cavities 2 and 3. Each such cavity 2, 3 has in the illustrated embodiment, cubical shape. The filter 1 has a signal inlet 5 at an end wall 7 and a signal outlet 6 at another end wall 9 opposite thereto.

The cavity 2 is designed such that radio signals of three different modes, represented by arrows A, B and C, and the same frequency, are filtered simultaneously in said cavity 2. A compensating means 13 is provided therein for compensating changes or deviations in frequency depending on expansion or contraction of the cavity 2 due to expansion or contraction of the filter 1 when said filter during operation is heated or cooled. The compensating means l3 is provided in said cavity 2 to compensate for deviations in frequency by simultaneously affecting radio signals of all three different modes A, B, C.

In the illustrated embodiment, a coupling 15 is provided in an intermediate wall 14 between the cavities 2, 3 and said coupling is adapted to permit transmission of the modes A, B and C from the cavity 2 to the cavity 3. The three different modes in the cavity 3 are designed for simultaneous filtration of radio signals of three different modes, represented by the arrows D, E and F, and the same frequency. In the cavity 3 there is provided a compensating means 16 to compensate for deviations in frequency depending on expansion or contraction of the cavity due to expansion or contraction of the filter during heating or cooling thereof while in operation. The compensating means 16 is provided in the cavity 3 to compensate for deviations in frequency by simultaneously affecting radio signals of all three different modes D, E, F.

Each compensating means 13 and 16 respectively, may include a bracket 17 which is fixedly mounted in a suitable location on the filter, e.g. in a corner of the cavity 2 and 3 respectively. If the bracket is e.g. located in a lower corner in the cavity 2 and 3 respectively, it may be directed diagonally towards an opposite upper corner in the cavity 2 and 3 respectively. On the bracket 17 there is provided at least one dielectric member 18 which is adapted to affect or influence the radio signals and which is movably mounted in the cavity 2 and 3 respectively, in relation to the modes A, B, C and D, E, F respectively, therein. If the bracket 17 is diagonally oriented, the dielectric member 18 will thus move diagonally in the cavity 2 and 3 respectively. In combination with that the dielectric member 18 is movable or, as an alternative thereto, the bracket 17 can be movably mounted on the filter 1 and it can be fixed in selected positions relative to the cavity 2 and 3 respectively. If the bracket 17 is moved diagonally in the cavity 2 and 3 respectively, the dielectric member 18 is of course displaced in the same direction.

The dielectric member 18 preferably consists of a plastic or a ceramic material. A preferred example of plastic material is fluoroethylene. The shape of the dielectric member 18 may be spherical or substantially spherical, but other shapes may also be used. The bracket 17 may be made of the same material as the member 18.

In order to compensate for deviations or changes in frequency generated by changes in temperature in the filter 1, each compensating means 13, 16 preferably cooperates with a temperature sensor 19 which is provided to sense temperature changes in the filter 1. The temperature sensor 19 is preferably located at the outside of the filter 1 and changes in temperature sensed thereby are transmitted to a setting device 20 for adjustment of the dielectric member 18 relative to the bracket 17 in the longitudinal direction.

The setting device 20 may be designed in different ways for receiving temperature changes in the temperature sensor 19 and transform them into movements for displacing the dielectric member 18 as mentioned. An example of a setting device 20 for this purpose is a container 21 with a liquid 22, e.g. alcohol, which expands or contracts when subjected to temperature changes. The container 21 has a plunger 23 protruding therefrom ,and moving in an outwards or inwards direction relative to the container 21 depending on whether the liquid therein is expanding or contracting.

The plunger 23 cooperates with one strand of an endless rope 24 or similar, e.g. of nylon, which is provided on the bracket 17. The dielectric member 18 is connected with one of the strands of the rope 24 such that said member 18 is moved or displaced in a direction along the bracket 17 when the plunger 23 is projected out of the container 21, and in the other direction when the plunger is retracted into the container 21.

As is apparent from the above description, the radio signals with three different modes A, B and C or D, E and F are filtered in one and the same cavity 2 or 3 instead of, as was previously necessary, filtering radio signals of three different modes A, B and C or D, E and F in three different cavities.

The filter 1 illustrated in the drawings has two cavities 2, 3 for filtering radio signals of three different modes A, B and C and D, E and F and the same frequency. The filter 1 however, may have one, three or several cavities for filtering radio signals of three different modes A, B and C. The filter 1 may, in combination with one or more cavities for filtration of radio signals of different modes and the same frequency in each cavity, have one or more cavities for filtering radio signals having one or mare modes in each cavity.

The filter 1 may also have one or more cavities and compensating means which are designed and provided for filtration of radio signals of more than three modes in each cavity, and the same frequency.

Figure 4:
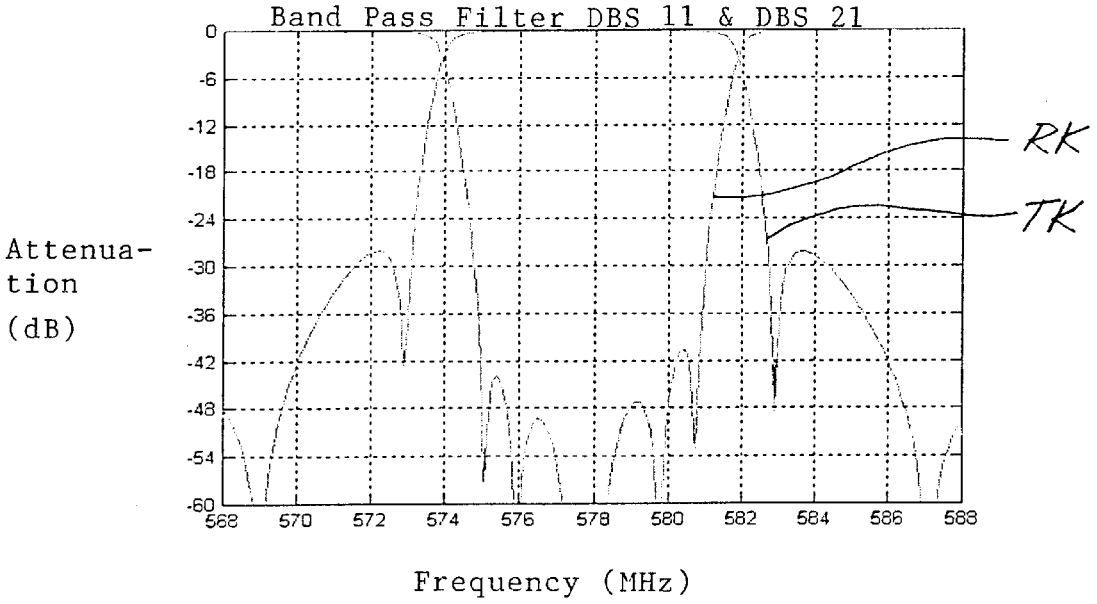
FIG. 4 is a diagram regarding frequency/attenuation/band pass filter with reflection and transmission graphs obtained or plotted with a filter according to the invention.

The diagram of FIG. 4 shows the values for, at the lower horizontal line frequencies (MHz), at the vertical line attenuation (dB) and at the upper horizontal line band pass filter DBS 11 & DBS 21. The diagram shows graphs plotted when measuring the properties of a filter 1 according to the invention. Thus, the graph RK is a reflection graph (S11; reflection loss) through the filter 1 and the graph TK a transmission graph (S21; transmission loss) through the filter 1.

The invention is not limited to what is described above and illustrated in the drawings, but may vary within the scope of the subsequent claims. As an example of not specifically described but possible embodiments, it should be mentioned that the filter can be used when combining radio transmitters. Also the cavities may have another shape than cubical shape and the shape of the cavities and the shape and/or location of the compensating means may vary depending on the number of modes of the radio signals to be filtered in the respective cavity. The temperature sensor 19 and the setting device 20 may be located and designed differently from what is stated above and illustrated in the drawings.

What is claimed is:

1. Device at filters for filter unwanted signals from radio transmitters and/or for use during combination of radio transmitters, wherein said filter (1) has a at least one cavity (2 and/or 3) for filtering radio signals, and wherein at least one compensating means (13 and/or 16) is provided to compensate for deviations in frequency depending on expansion or contraction of the cavity (2 and/or 3) due to expansion or contraction of the filter (1) when said filter (1) is heated or cooled during operation, characterized in that the filter (1) has at least one cavity (2 and/or 3) which is designed for simultaneous filtering of radio signals of at least three different modes (A, B and C and/or D, E and F) and the same frequency, and that the compensating means (13 and/or 16) is provided in said cavity (2 and/or 3) for compensating deviations in frequency by simultaneously affecting the radio signals of the at least three different modes (A, B and C and/or D, E and F), and characterized in that the compensating means (13 and/or 16) comprises a member (18) which is movable in the cavity (2 and/or 3) depending on temperature changes in the filter (1) and which is provided to affect the radio signals of the three different modes (A, B and C and/or D, E and F) and movement of the movable member (18) changing the magnetic field in the cavity (2 and/or 3) without changing the volume of the cavity (2 and/or 3).

2. Device according to claim 1, characterized in that the radio signals lie within a range of frequencies of 300 MHz–3 GHz and within a power range of 200 W–50 kW.

3. Device according to claim 1, characterized in that at least one temperature sensor (19) is provided to sense changes in temperature in the filter (1), and that at least one setting device (20) is provided to move said member (18) of the compensating means (13 and/or 16) in the cavity (2 and/or 3) depending on temperature changes in the filter (1) sensed by the temperature sensor(19).

4. Device according to claim 3, characterized in that the setting device (20) comprises a container (21) with a liquid (22) which is expanding or contracting depending on temperature changes in the filter (1) sensed by the temperature sensor (19), that a plunger (23) is provided for displacement in dependence of the expansion or contraction of the liquid (22), and that the plunger (23) cooperates with a rope (24) in order to displace, during its movement, said member (18) in the cavity (2 and/or 3) along a bracket (17) forming part of the compensating means (13 and/or 16).

5. Device according to claim 1, characterized in that the movable member (18) of the compensating means (13 and/or 16) for affecting the radio signals of the three different modes ((A, B and C and/or D, E and F) is dielectric, and that said member (18) is movably mounted on a bracket (17) which is dielectric.

6. Device according to claim 5, characterized in that the dielectric member (18) and also the bracket (17) consist of a plastic and/or ceramic material.

7. Device according to claim 6, characterized in that the dielectric member (18) and also the bracket (17) consist of fluoroethylene.

8. Device according to claim 1, characterized in that the compensating means (13 and/or 16) and/or a member (18) thereof, for alignment or trimming of the compensation, is movable in the cavity (2 and/or 3) in relation to the radio signals of the three different modes (A, B and C and/or D, E and F) therein.

9. Device according to claim 1, characterized in that the filter (1) has at least one cubical or substantially cubical cavity (2 and/or 3) which is designed for simultaneous filtering of radio signals of three different modes (A, B and C and/or D, E and F) and the same frequency, and that the compensating means (13 and/or 16) is provided to compensate for deviations in frequency by simultaneously affecting the radio signals of the three different modes (A, B and C and/or D, E and F).

10. Device according to claim 1, characterized in that the compensating means (13 and/or 16) and/or a member (18) thereof is movable in diagonal direction relative to the cavity (2 and/or 3).

11. Device according to claim 1, characterized in the compensating means (13 and/or 16) includes a bracket (17) and a spherical member (18) movably mounted thereon for affecting the radio signals of the three different modes (A, B and C and/or D, E and F).

12. Device according to claim 1, characterized in that the filter (1) has a plurality of cavities (2 and 3) which are designed for simultaneous filtering of radio signals of at least three different modes and the same frequency, and that the filter (1) further includes at least one cavity which is designed for filtration of radio signals of one mode and one frequency.

13. Device according to claim 1, characterized in that the filter (1) includes at least two cavities (2, 3) located beside each other, that in an intermediate wall (14) between the cavities (2, 3) there is provided a coupling to permit transmission of modes (A, B and C) from one cavity (2) to the other cavity (3) for generation of modes (D, E and F) in said other cavity (3), and that each cavity (2, 3) has at least one compensating means (13 and 16 respectively) for compensating frequency deviations or changes in each cavity (2 and 3 respectively).

14. Device at filters for filtering unwanted signals from radio transmitters and/or for use during combination of radio transmitters, wherein said filter (1) has at least one cavity (2 and/or 3) for filtering radio signals, and wherein at least one compensating means (13 and/or 16) is provided to compensate for deviations in frequency depending on expansion or contraction of the cavity (2 and/or 3) due to expansion or contraction of the filter (1) when said filter (1) is heated or cooled during operation, characterized in that the filter (1) has at least one cavity (2 and/or 3) which is designed for simultaneous filtering of radio signals of at least three different modes (A, B and C and/or D, E and F) and the same frequency, and that the compensating means (13 and/or 16) is provided in said cavity (2 and/or 3) for compensating deviations in frequency by simultaneously affecting the radio signals of the at least three different modes (A, B and C and/or D, E, and F), and characterized in that the radio signals lie within a range of frequencies of 300 MHz–3 GHz and within a power range of 200 W–50 kW.

15. Device at filters for filtering unwanted signals from radio transmitters and/or for use during combination of radio transmitters, wherein said filter (1) has at least one cavity (2 and/or 3) for filtering radio signals, and wherein at least one compensating means (13 and/or 16) is provided to compensate for deviations in frequency depending on expansion or contraction of the cavity (2 and/or 3) due to expansion or contraction of the filter (1) when said filter (1) is heated or cooled during operation, characterized in that the filter (1) has at least one cavity (2 and/or 3) which is designed for simultaneous filtering of radio signals of at least three different modes (A, B and C and/or D, E and F) and the same frequency, and that the compensating means (13 and/or 16) is provided in said cavity (2 and/or 3) for compensating deviations in frequency by simultaneously affecting the radio signals of the at least three different modes (A, B and C and/or D, E, and F), and characterized in that the filter (1) has a plurality of cavities (2 and 3) which are designed for simultaneous filtering of radio signals of at least three different modes and the same frequency, and that the filter (1) further includes at least one cavity which is designed for filtration of radio signals of one mode and one frequency.

16. Device at filters for filtering unwanted signals from radio transmitters and/or for use during combination of radio transmitters, wherein said filter (1) has at least one cavity (2 and/or 3) for filtering radio signals, and wherein at least one compensating means (13 and/or 16) is provided to compensate for deviations in frequency depending on expansion or contraction of the cavity (2 and/or 3) due to expansion or contraction of the filter (1) when said filter (1) is heated or cooled during operation, characterized in that the filter (1) has at least one cavity (2 and/or 3) which is designed for simultaneous filtering of radio signals of at least three different modes (A, B and C and/or D, E, and F) and the same frequency, and that the compensating means (13 and/or 16) is provided in said cavity (2 and/or 3) for compensating deviations in frequency by simultaneously affecting the radio signals of the at least three different modes (A, B and C and/or D, E, and F), and characterized in that the compensating means (13 and/or 16) comprises a member (18) which is movable in the cavity (2 and/or 3) depending on temperature changes in the filter (1) and which is provided to affect the radio signals of the three different modes (A, H and C and/or D, E and F), and characterized in that at least one temperature sensor (19) is provided to sense changes in temperature in the filter (1), and that at least one setting device (20) is provided to move said member (18) of the compensating means (13 and/or 16) in the cavity (2 and/or 3) depending on temperature changes in the filter (1) sensed by the temperature sensor (19).

17. Device according to claim 16, characterized in that the setting device (20) comprises a container (21) with a liquid (22) which is expanding or contracting depending on temperature changes in the filter (1) sensed by the temperature sensor (19), that a plunger (23) is provided for displacement in dependence of the expansion or contraction of the liquid (22), and that the plunger (23) cooperates with a rope (24) in order to displace, during its movement, said member (18) in the cavity (2 and/or 3) along a bracket (17) forming part of the compensating means (13 and/or 16).

18. Device at filters for filtering unwanted signals from radio transmitters and/or for use during combination of radio transmitters, wherein said filter (1) has at least one cavity (2 and/or 3) for filtering radio signals, and wherein at least one compensating means (13 and/or 16) is provided to compensate for deviations in frequency depending on expansion or contraction of the cavity (2 and/or 3) due to expansion or contraction of the filter (1) when said filter (1) is heated or cooled during operation, characterized in that the filter (1) has at least one cavity (2 and/or 3) which is designed for simultaneous filtering of radio signals of at least three different modes (A, B and C and/or D, E and F) and the same frequency, and that the compensating means (13 and/or 16) is provided in said cavity (2 and/or 3) for compensating deviations in frequency by simultaneously affecting the radio signals of the at least three different modes (A, B and C and/or D, E, and F), characterized in that the movable member (18) of the compensating means (13 and/or 16) for affecting the radio signals of the three different modes (A, B and C and/or D, E and F) is dielectric, and that said member (18) is movably mounted on a bracket which is dielectric.

19. Device according to claim 18, characterized in that the dielectric member (18) and the bracket (17) consist of a plastic and/or ceramic material.

20. Device according to claim 19, characterized in that dielectric member (18) and the bracket (17) consist of fluoroethylene.

21. Device at filters for filtering unwanted signals from radio transmitters and/or for use during combination of radio transmitters, wherein said filter (1) has at least one cavity (2 and/or 3) for filtering radio signals, and wherein at least one compensating means (13 and/or 16) is provided to compensate for deviations in frequency depending on expansion or contraction of the cavity (2 and/or 3) due to expansion or contraction of the filter (1) when said filter (1) is heated or cooled during operation, characterized in that the filter (1) has at least one cavity (2 and/or 3) which is designed for simultaneous filtering of radio signals of at least three different modes (A, B and C and/or D, E and F) and the same frequency, and that the compensating means (13 and/or 16) is provided in said cavity (2 and/or 3) for compensating deviations in frequency by simultaneously affecting the radio signals of the at least three different modes (A, B and C and/or D, E, and F), and characterized in that the compensating means (13 and/or 16) and/or a member (18) thereof is movable in diagonal direction relative to the cavity (2 and/or 3).

22. Device at filters for filtering unwanted signals from radio transmitters and/or for use during combination of radio transmitters, wherein said filter (1) has at least one cavity (2 and/or 3) for filtering radio signals, and wherein at least one compensating means (13 and/or 16) is provided to compensate for deviations in frequency depending on expansion or contraction of the cavity (2 and/or 3) due to expansion or contraction of the filter (1) when said filter (1) is heated or cooled during operation, characterized in that the filter (1) has at least one cavity (2 and/or 3) which is designed for simultaneous filtering of radio signals of at least three different modes (A, B and C and/or D, E and F) and the same frequency, and that the compensating means (13 and/or 16) is provided in said cavity (2 and/or 3) for compensating deviations in frequency by simultaneously affecting the radio signals of the at least three different modes (A, B and C and/or D, E, and F), and characterized in that the compensating means (13 and/or 16) includes a bracket (17) and a spherical member (18) movably mounted thereon for affecting the radio signals of the three different modes (A, B and C and/or D, E and F).

23. Device at filters for filtering unwanted signals from radio transmitters and/or far use during combination of radio transmitters, wherein said filter (1) has at least one cavity (2 and/or 3) for filtering radio signals, and wherein at least one compensating means (13 and/or 16) is provided to compensate for deviations in frequency depending on expansion or contraction of the cavity (2 and/or 3) due to expansion or contraction of the filter (1) when said filter (1) is heated or cooled during operation, characterized in that the filter (1) has at least one cavity (2 and/or 3) which is designed for simultaneous filtering of radio signals of at least three different modes (A, B and C and/or D, E and F) and the same frequency, and that the compensating means (13 and/or 16) is provided in said cavity (2 and/or 3) for compensating deviations in frequency by simultaneously affecting the radio signals of the at least three different modes (A, B and C and/or D, E, and F), and characterized in that the filter (1) includes at least two cavities (2,3) located beside each other, that in an intermediate wall (14) between the cavities (2,3) there is provided a coupling to permit transmission of modes (A, B and C) from one cavity (2) to the other cavity (3) for generation of modes (D, E and F) in said other cavity (3), and that each cavity (2, 3) has at least one compensating means (13 and 16 respectively) for compensating frequency deviations or changes in each cavity (2 and 3 respectively).

* * * * *

UNITED STATES PATENT AND TRADEMARK OFFICE

CERTIFICATE OF CORRECTION

PATENT NO. : 6,549,103 B2 
DATED : April 15, 2003
INVENTOR(S) : Ju Jilong

It is certified that error appears in the above-identified patent and that said Letters Patent is hereby corrected as shown below:

Column 6,
Line 28, delete "H" and insert -- B --.

Signed and Sealed this

Twenty-eighth Day of October, 2003

JAMES E. ROGAN
*Director of the United States Patent and Trademark Office*